United States Patent [19]

Araki

[11] Patent Number: 4,564,032

[45] Date of Patent: Jan. 14, 1986

[54] HAIR CURLER

[75] Inventor: Masakatsu Araki, Hikone, Japan

[73] Assignee: Matsushita Electric Works, Ltd., Osaka, Japan

[21] Appl. No.: 381,574

[22] Filed: May 24, 1982

[30] Foreign Application Priority Data

May 30, 1981 [JP] Japan ..... 56-82958

[51] Int. Cl.[4] ..... A45B 25/18

[52] U.S. Cl. ..... 132/33 R; 132/40; 132/37 A; 219/222

[58] Field of Search ..... 132/37 R, 71 R, 39, 132/40, 42, 33, 32 R, 31 R; 219/222, 225

[56] References Cited

U.S. PATENT DOCUMENTS

| | | | |
|---|---|---|---|
| 2,665,443 | 1/1954 | Simon | 15/1.5 A |
| 2,937,976 | 5/1960 | Granahan | 128/DIG. 21 |
| 3,713,455 | 1/1973 | Chen | 132/40 |
| 3,931,826 | 1/1976 | Moon | 132/9 |
| 4,209,685 | 6/1980 | Walter | 132/37 R |
| 4,260,871 | 4/1981 | Nagelkerke | 132/39 |
| 4,314,137 | 2/1982 | Dörn | 132/11 R |
| 4,327,753 | 5/1982 | Bertschi | 132/40 |
| 4,358,660 | 11/1982 | Andis | 132/37 A |

*Primary Examiner*—Gregory E. McNeill

*Attorney, Agent, or Firm*—Stevens, Davis, Miller & Mosher

[57] ABSTRACT

A bristle-mounting platform and bristles are integrally fabricated from silicone rubber and incorporated into the hair-winding portions or attachments of hair appliances such as hair curlers. With such hair appliances, hair is easily disentangled without damage to the hair. In addition, the hair appliances will not deteriorate or deform under high temperature operating conditions.

20 Claims, 34 Drawing Figures

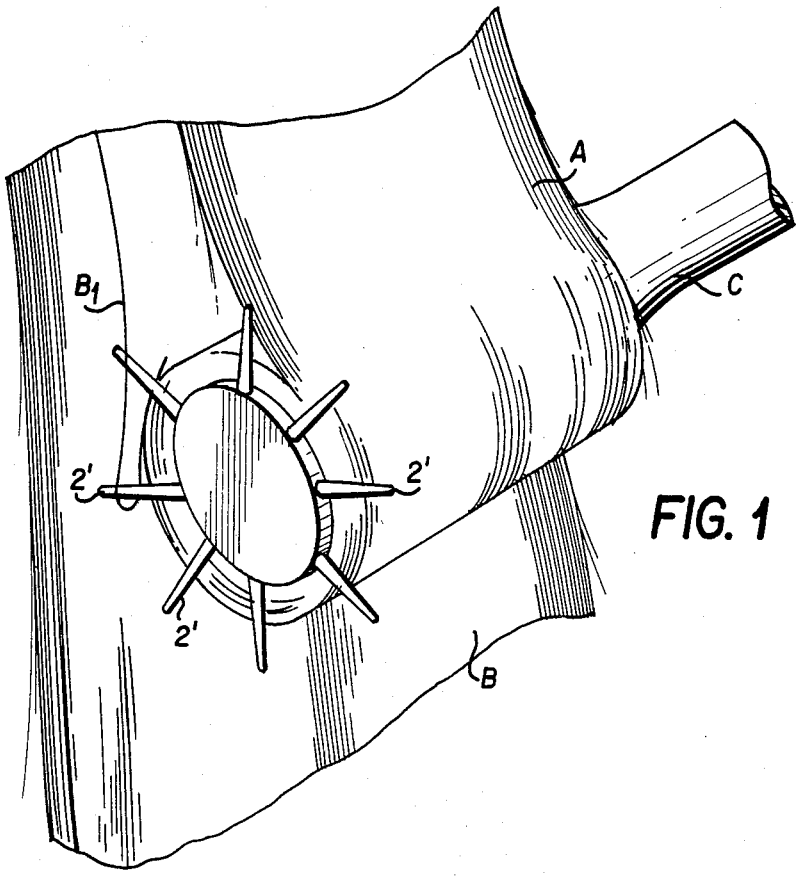
FIG. 1
FIG. 2A
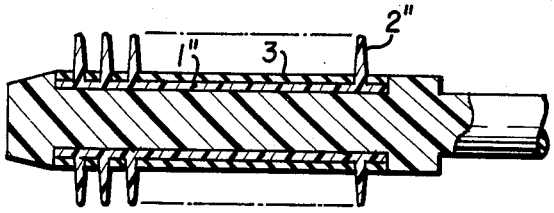
FIG. 2B
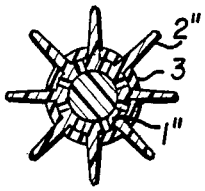
FIG. 3
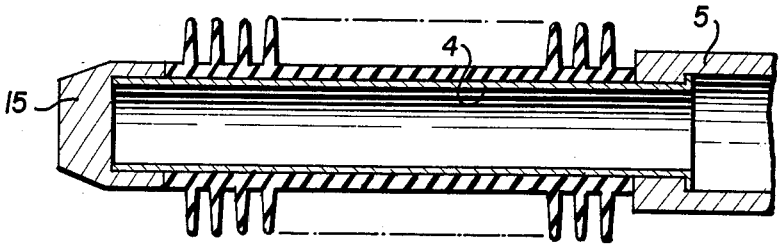

FIG. 4
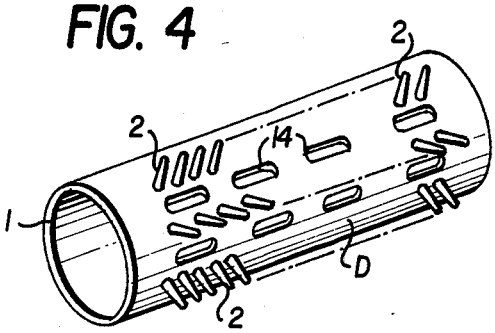
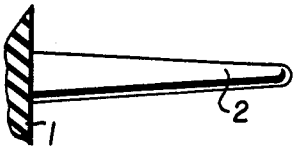
FIG. 5
FIG. 6A
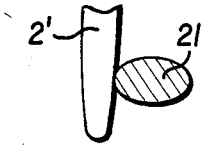
FIG. 6B
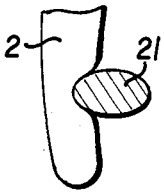
FIG. 7
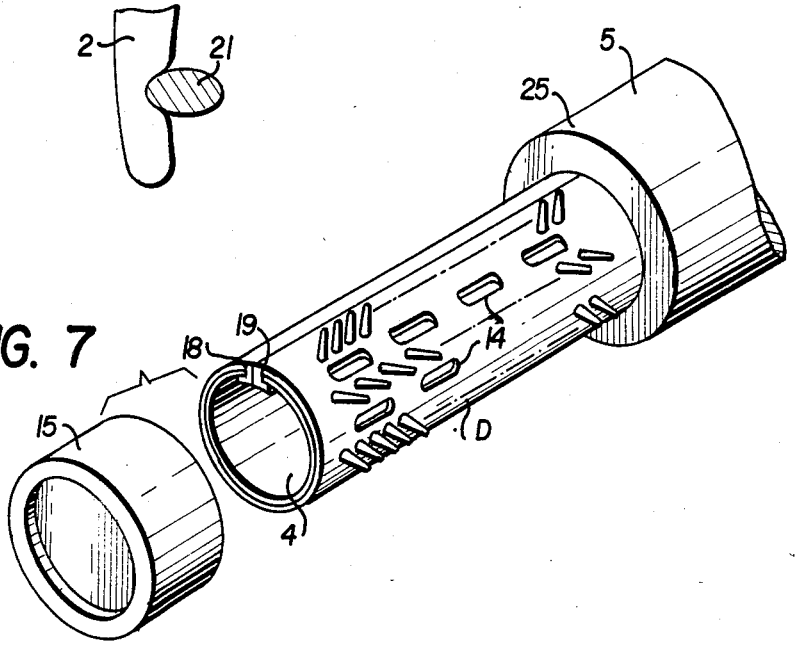
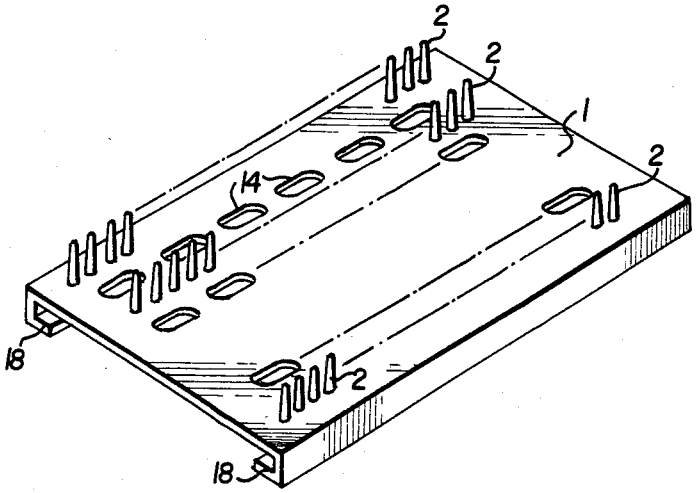
FIG. 8

FIG. 12
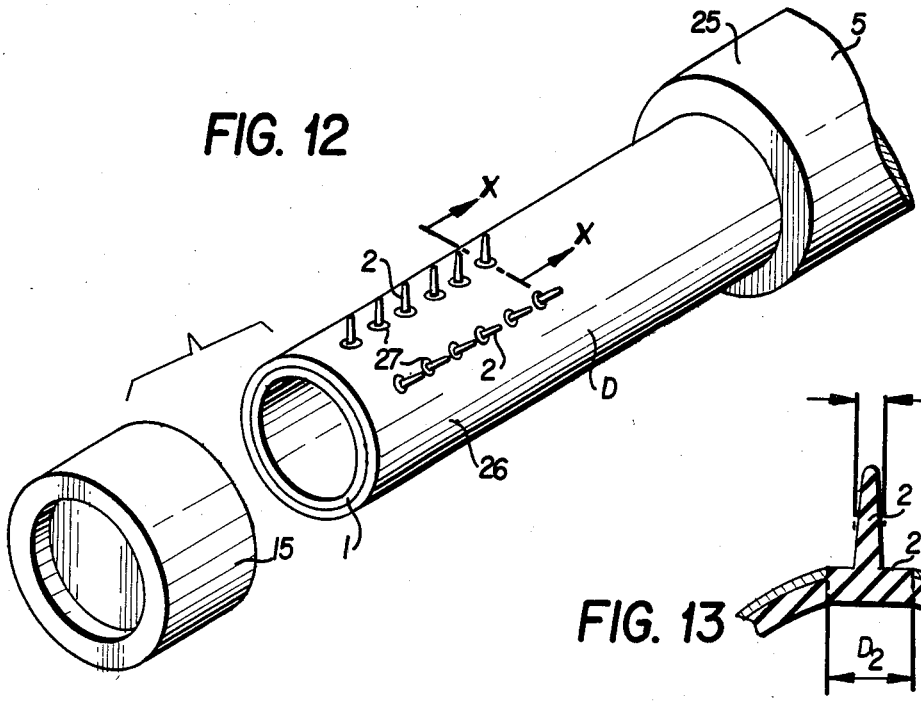
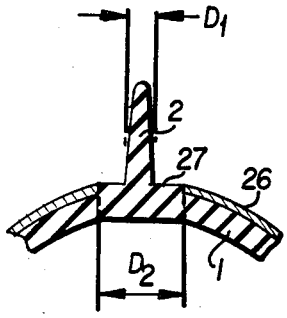
FIG. 13
FIG. 14
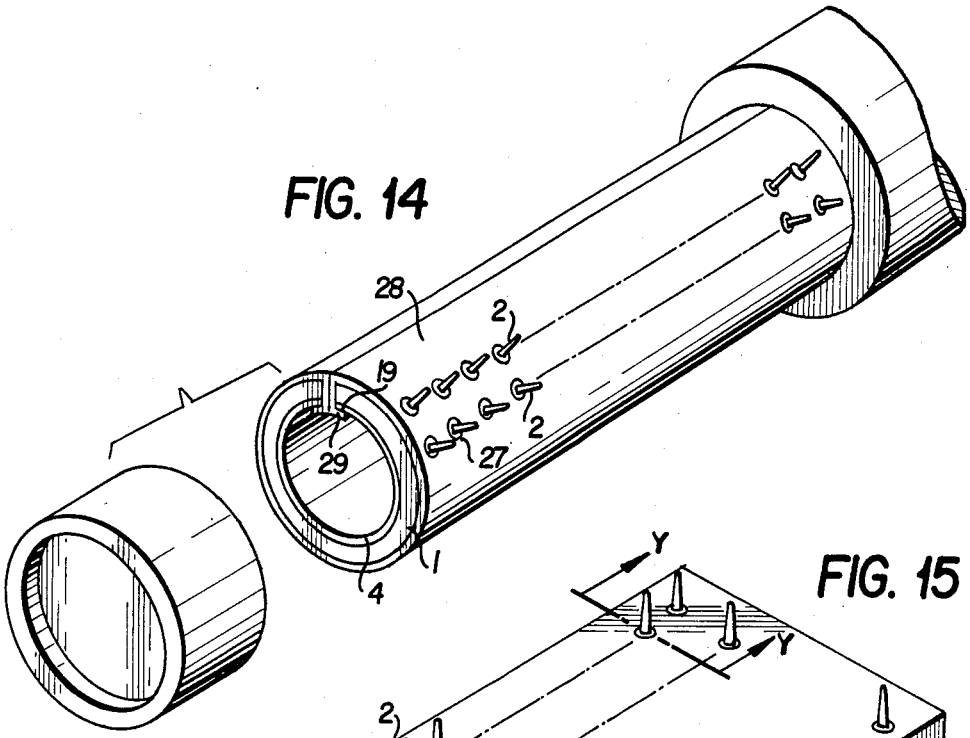
FIG. 15
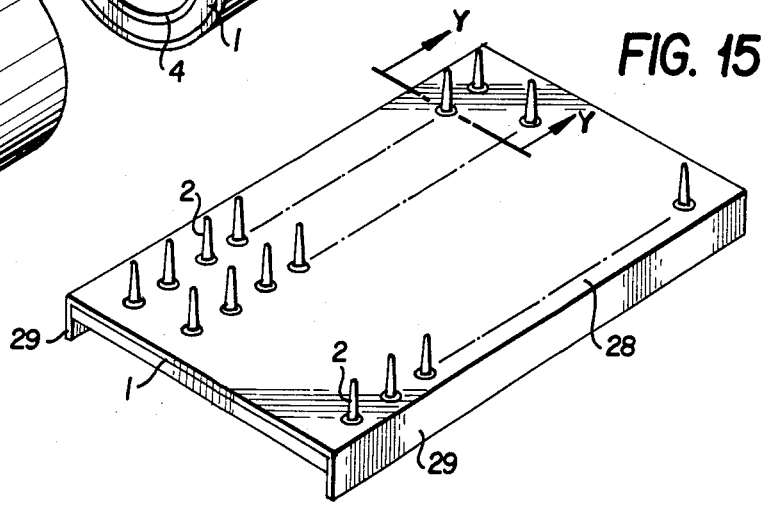

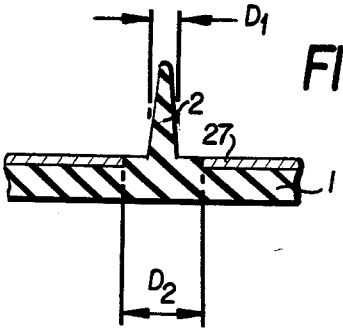
FIG. 16
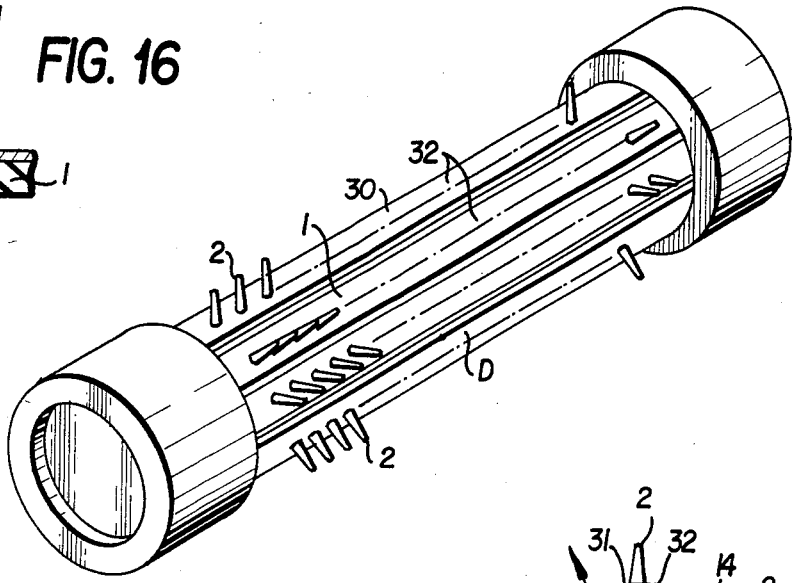
FIG. 17
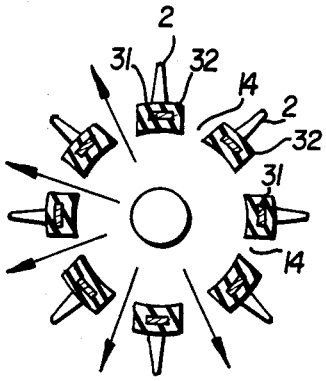
FIG. 18
FIG. 19
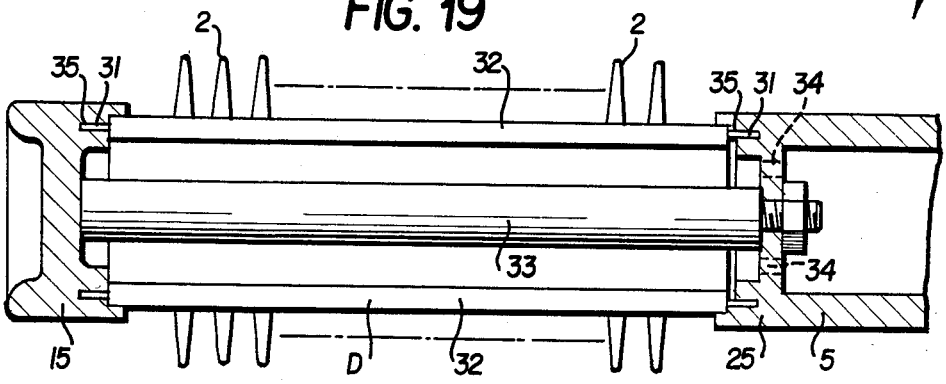
FIG. 20
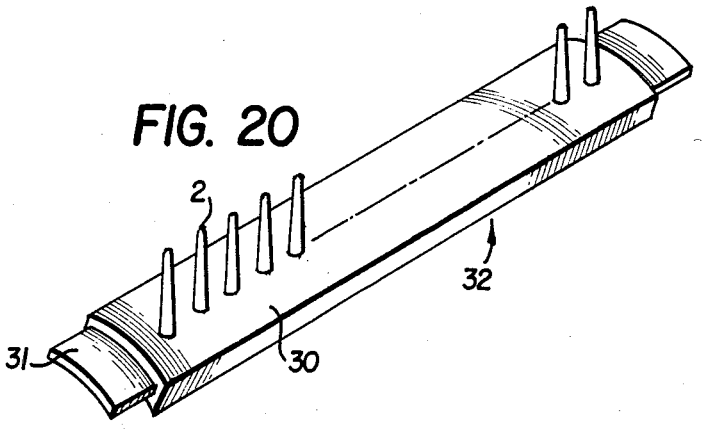

HAIR CURLER

BACKGROUND OF THE INVENTION

The present invention relates to hair curlers and related appliances, particularly electric hair curlers and appliances of the hand-held type.

Electric hair curlers and appliances of the hand-held type are generally known, but have several disadvantages. For example, in many conventional hair curlers and appliances, hair is wound around a cylindrical hair-winding portion or attachment which has bristles disposed along its length. These bristles are quite hard and lack any significant flexibility. Thus, hair wound on the portion or attachment becomes entangled in these bristles and is very difficult to disentangle. This disadvantage displays itself in several ways. For example, a bundle of hair may be wound around the hair-winding portion or attachment in such a way that the bristles protrude beyond the wound hair and become entangled in another bundle of hair located beneath the first bundle. This kind of entanglement is often associated with entanglement of the wound hair with the bristles.

The "cushion brush" type of hair curler or appliance, known in the art, attempts to overcome these disadvantages by mounting its hard bristles on a flexible rubber bristle-mounting platform and restricting the movement of the bristles by enveloping the bristle-mounting platform with a harder layer through which the bristles project. However, it suffers from the disadvantage of hair binding by the rubber bristle-mounting platform which reduces the movement of the bristles so much that entanglement occurs. Further, assembly of the "cushion brush" hair curler or appliance is complicated.

SUMMARY OF THE INVENTION

It is therefore an object of the present invention to provide a hair curler or appliance having a hair-winding attachment or portion which will permit hair to become disentangled from its hair-winding bristles easily and surely. It is a further object of the present invention to provide such a hair curler or appliance which is easy to manufacture and assemble. These objects are achieved by the novel use of silicone rubber.

BRIEF DESCRIPTION OF THE DRAWINGS

FIG. 1 is a perspective view of a conventional hair curler as employed in curling hair;

FIGS. 2(*a*) and 2(*b*) are, respectively, a front view in cross-section, and a side view, in cross-section, of the hair-winding portion of a second type of conventional hair curler;

FIG. 3 is a front view, in cross-section, of the hair-winding portion of a first embodiment of the hair curler of the claimed invention;

FIG. 4 is a perspective view of the bristle-mounting platform of the hair curler shown in FIG. 3;

FIG. 5 is a detail of the hair curler shown in FIG. 3, showing a bristle thereof;

FIGS. 6(*a*) and 6(*b* ) show the special characteristics of the bristle shown in FIG. 5;

FIG. 7 is an exploded perspective view showing the hair-winding portion of a second embodiment of the hair curler of the claimed invention;

FIG. 8 is a perspective view of the bristle-mounting platform of the hair curler shown in FIG. 7 prior to its incorporation therein;

FIG. 12 is an exploded perspective view showing the hair-winding portion of a fifth embodiment of the hair curler of the claimed invention;

FIG. 13 is a detail, in cross-section, of the hair curler of FIG. 12, taken along line X—X thereof;

FIG. 14 is an exploded perspective view of the hair-winding portion of a sixth embodiment of the hair curler of the claimed invention;

FIG. 15 is a perspective view of the bristle-mounting platform of the hair curler of FIG. 14 prior to its incorporation therein;

FIG. 16 is a detail, in cross-section, of the platform of FIG. 15 taken along line Y—Y thereof;

FIG. 17 is a perspective view showing the hair-winding portion of a seventh embodiment of the hair curler of the claimed invention;

FIG. 18 is a side view, in cross-section, of the hair curler of FIG. 17;

FIG. 19 is a front view, in cross-section, of the hair curler of FIG. 17;

FIG. 20 is a perspective view of one of the bristle-mounting strips of the hair curler of FIG. 17;

DETAILED DESCRIPTION OF THE INVENTION

Figure 9:
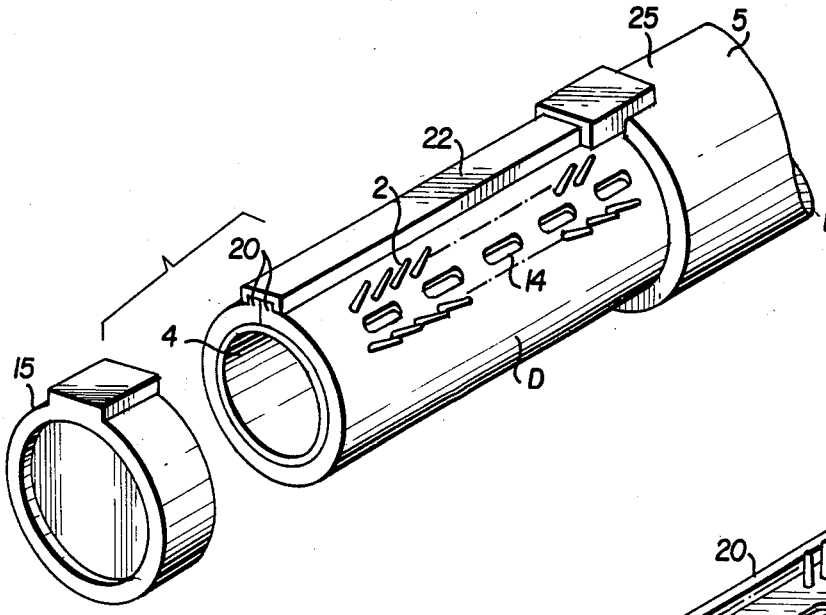
FIG. 9 is an exploded perspective view of the hair-winding portion of a third embodiment of the hair curler of the claimed invention.

Referring first to FIG. 1, this illustrates a conventional hair curler C as actually employed in curling hair. The hair curler C is equipped with a hair-winding portion having bristles 2'. A bundle of hair A is shown being wound around the hair-winding portion of the hair curler C. As mentioned, because the bristles 2' are hard and lack flexibility, the hair in bundle A is likely to become entangled and cannot be disentangled except with great difficulty and possible harm to the hair. In addition, if bristles 2' project through wound hair bundle A they may also entangle hair from other bundles, such as hair $B_1$, of hair bundle B. Indeed, the two kinds of entangling are often associated with one another.

Referring now to FIGS. 2(*a*) and 2(*b*), these illustrate a second type of conventional hair curler, known as a "cushion brush", which attempts to overcome the disadvantages of the hair curler illustrated in FIG. 1. In this "cushion brush" hair curler, the hard bristles 2″ are mounted on a flexible rubber bristle-mounting platform 1″. To control the movement of the bristles an envelope 3 of harder material surrounds the flexible rubber bristle-mounting platform 1″. The bristles 2″ project through the envelope 3, but since the root portions of the bristles 2″ are surrounded by envelope 3, their free movement is restricted. However, the "cushion brush" hair curler has the disadvantage that the flexible rubber bristle-mounting platform can bind hair wound on the hair curler, resulting in the bristles being so restricted in their movement that entanglement occurs. In addition, the "cushion brush" hair curler is quite complicated in manufacture and assembly.

FIGS. 3 and 4 show a first embodiment of the claimed invention. A hair-winding portion or attachment for a hair curler or related hair appliance is comprised of a hollow rod assembly D detachably fixed at one of its ends to the main body 5 of the hair curler or related appliance (which may include means for heating or blowing hot air) and a cap 15 which caps hollow rod assembly D at its other end. Rod assembly D is comprised of an internal cylinder 4 surrounded by a cylindrical bristle-mounting platform 1 from which project bristles 2. Bristle-mounting platform 1 and bristles 2 are integrally fabricated from silicone rubber; the internal cylinder 4 is of relatively hard material. For example internal cylinder 4 may be made of highly thermal conductive metal such as aluminum. Both bristle-mounting platform 1 and internal cylinder 4 may include corresponding hot air outlets 14 for blowing out hot air.

Figure 26A:
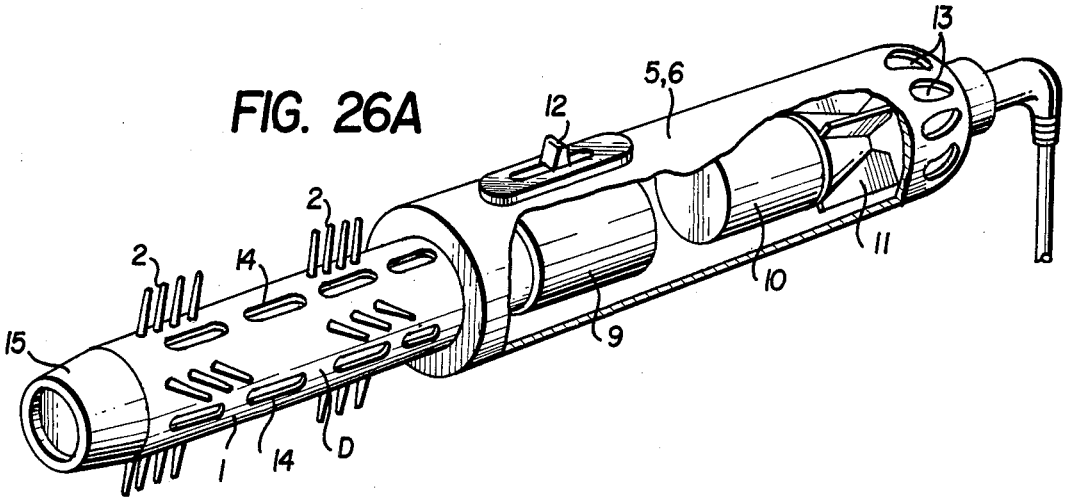
FIGS. 26(*a*), 26(*b*), 26(*c*) and 27 are perspective views showing the hair-winding portion of the claimed invention on a variety of main bodies.
Figure 26B:
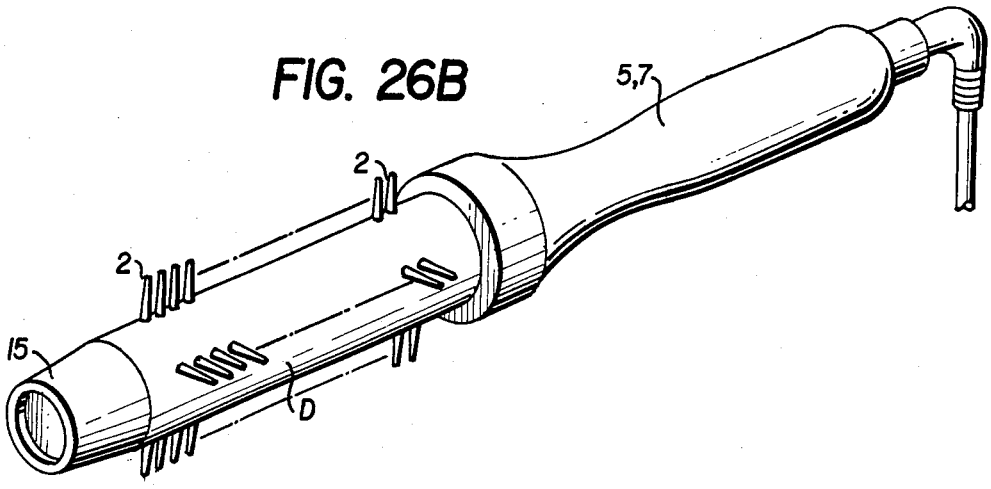
Figure 26C:
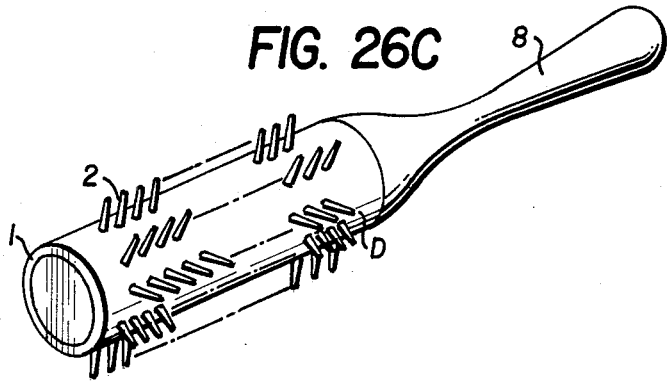

The hair-winding portion or attachment including rod assembly D may be incorporated in a great variety of hair appliances. FIG. 26(*a*), shows the hair-winding portion or attachment attached to the main body 5 of a hair appliance for blowing hot air 6. In operation, ambient air is drawn in through air inlets 13 by fan 11 which is driven by motor 10 and heated as it passes heater 9. These components are arranged in main body 5 and controlled by electrical switch 12 in the usual manner. The heated air in the blower out through the hot air outlets of the hair-winding portion or attachment.

Figure 27:
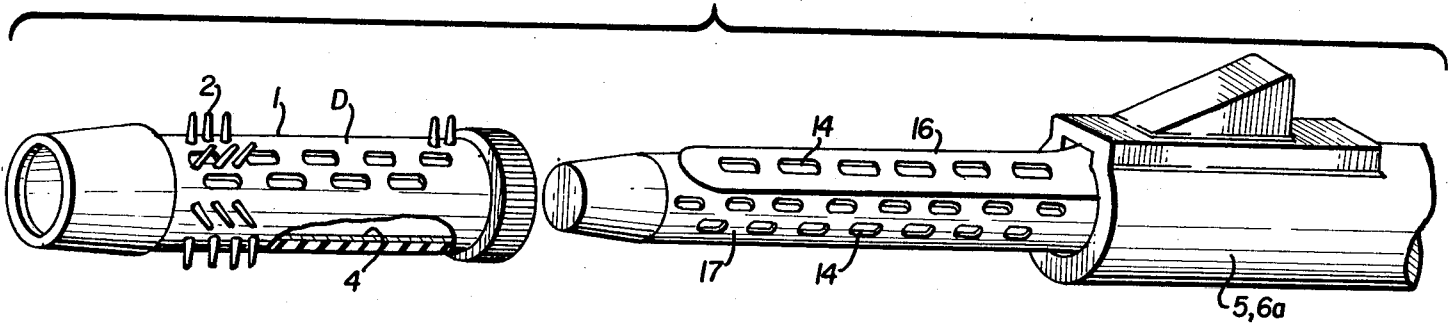

FIG. 26(*b*) shows the hair-winding portion or attachment attached to main body 5 of a hair iron 7 provided with a heater therein. Alternatively, the hair-winding attachment or portion assembly may be mounted on a handle 8 to form a hair iron which is heated by an external heater prior to being used on the hair. It will be noted that since neither hair iron in FIGS. 26(*b*) or 26(*c*) employs blowing hot air through the hair-winding attachment or portion, the hot air outlets 14 are unnecessary and have been eliminated. In addition, as shown in FIG. 27, incorporation of the hair-winding attachment or portion in a combination hair iron and roll-brush is possible if the main body 5 of hot air blowing hair appliance 6*a* is provided with a curling tube 17 and an associated movable hair gripping plate 16. The hair-winding attachment or portion may be detachably mounted on the main body 5 of the hot air blowing hair appliance 6*a* over curling tube 17 and gripping plate 16 to effect the combination.

Silicone rubber was selected as the material for bristle-mounting platform 1 and bristles 2 for several reasons:

(a) Bristles of silicone rubber have excellent resilience and recover from bending easily. As a result, such bristles have great durability also.

(b) Silicone rubber is stable at the high operating temperatures of hair appliances which employ heating such as hair curlers, hair irons and the like. Thus, bristles and bristle-mounting platforms of silicone rubber have great thermal endurance. Further, silicone rubber does not suffer permanent deformation (bending) due to heating during operation of such appliances and it is thus superior to thermoplastic elastomers in this respect.

(c) A larger friction force can be obtained between silicone rubber and hair. Thus, hair easily follows the rotation of the hair winding attachment of the hair appliance and bristles can wind hair easily;

(d) Although hair is frequently hurt by mechanical forces in brushing, bristles made of silicone rubber have a hardness lower than that of hair surfaces and are bent by a relatively low force if the hair is entangled when brushing. Thus, hair does not suffer an excessive force during brushing and damage to hair is prevented.

(e) Silicone rubber bristles have sufficient softness and flexibility to prevent entanglement of hair. Sufficient flexibility to prevent the entanglement of hair is defined as the spring constant K [load required for flexure of 1 mm (g/mm)] as calculated for a cantilever (bristle 2) projecting beyond the bristle-mounting platform 1 shown in FIG. 5. That is to say, when K is 6 to 20 g/mm, entanglement of hair can effectively be prevented and excellent combing attained.

(f) Silicone rubber has low surface hardness and, as shown in FIG. 6, bristles made of it adapt easily to the surface of the hair 21 when combing and have a marked effect of spreading sebaceous oil from the skin all over the hair.

FIGS. 7 and 8 show a second embodiment of the present invention. Silicone rubber bristle-mounting platform 1 is formed in a flat plate shape as shown in FIG. 8 with silicone rubber bristles 2 extending from its top surface, and has a pair of parallel fastening channels 18 extending from opposing edges of its bottom surface. The hard internal cylinder 4 is provided with a slit 19 extending over its length. The bristle-mounting platform 1 is mounted around internal cylinder 4 by engaging fastening channels 18 with the edges of internal cylinder 4 which define slit 19 to form rod assembly D. One end of rod assembly D is capped by cap 15 and the other end is secured by casing 25 of main body 5 of the hair appliance. The bristle-mounting platform 1 with its hot air outlets 14 and bristles 2 can be easily fabricated integrally in the flat plate shape. If internal cylinder 4 is made of a highly thermal conductive metal such as aluminum, heat is uniformly spread all over the wound hair, improving the curling effect.

Figure 10:
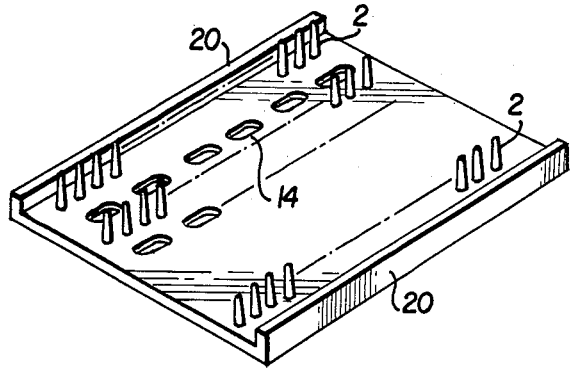
FIG. 10 is a perspective view of the bristle-mounting platform of the hair curler shown in FIG. 9 prior to its incorporation therein.

FIGS. 9 and 10 show a third embodiment of the present invention. Silicone rubber bristle-mounting element 1 is formed in a flat plate shape with silicone rubber bristles 2 extending from its top surface. A pair of parallel flanges 20 extends from opposing edges of the top surface of bristle-mounting platform 1 as well. When bristle-mounting platform 1 is mounted around hollow internal cylinder 4, the pair of flanges 20 meet to form a ridge along the length of cylinder 4 and are engaged and retained within channel-shaped fastener 22. So mounted, bristle-mounting platform 1 and internal cylinder 4 form rod assembly D. One end of rod assembly D is capped by cap 15 and the other end is secured by casing 25 of main body 5 of the hair appliance.

Figure 11:
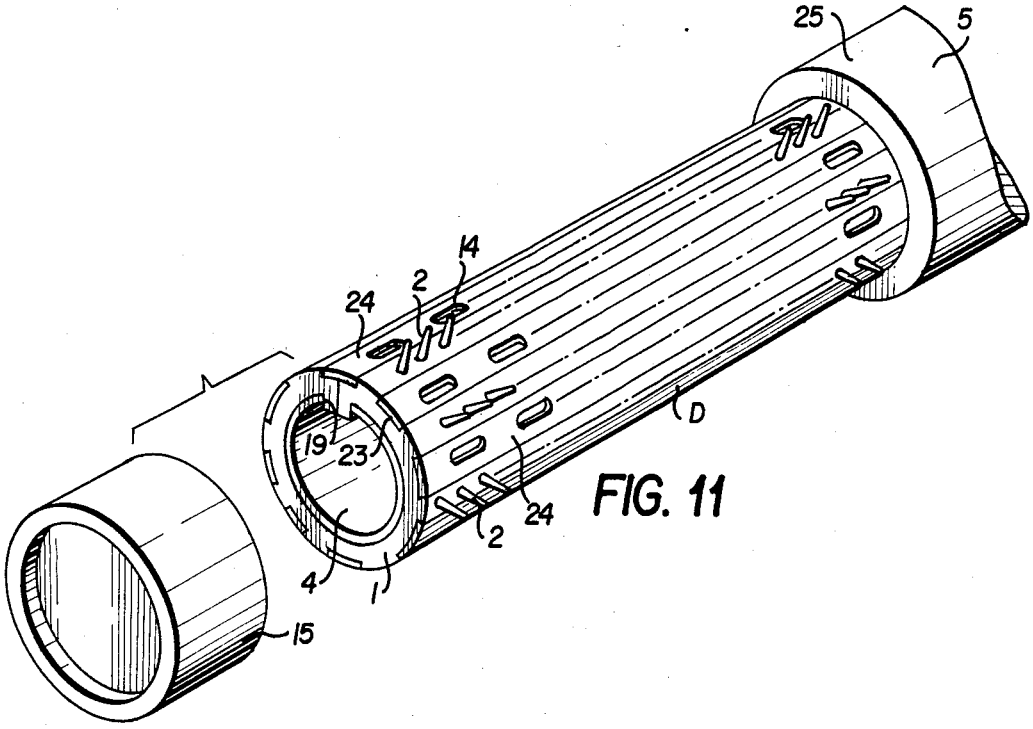
FIG. 11 is an exploded perspective view showing the hair-winding portion of a fourth embodiment of the hair curler of the claimed invention.

FIG. 11 shows a fourth embodiment of the present invention. A silicone rubber bristle-mounting platform 1 with silicone rubber bristles 2 is formed in flat plate shape similar to those described above and is mounted around a similar internal cylinder 4 to form rod assembly D. The top (external) surface of bristle-mounting platform 1 is provided with a plurality of grooves 23 along its length at fixed spaces from one another. Highly thermal conductive metal strips 24 such as strips of aluminum are inserted in said grooves 23. The strips may be held in place by having their ends retained by cap 15 (which caps one end of rod assembly D) and casing 25 of main body 5 (to which the other end of rod assembly D is attached). Hot air outlets 14 corresponding to those of bristle-mounting platform 1 (and internal cylinder 4) may be disposed along the thermal conductive metal strips 24. The highly thermal conductive metal bands 24 lead to better thermal conductance and thereby improve curling.

FIGS. 12 and 13 show a fifth embodiment of the present invention. Silicone rubber bristle-mounting platform 1 is mounted integrally on the internal surface of a cylinder 26 (the latter being made of highly thermal conductive metal such as aluminum and the like) to form rod assembly D. One end of rod assembly D is capped by cap 15 and the other end is secured to casing 25 of main body 5 of the hair appliance. Silicone rubber bristles 2, which are integral with bristle-mounting platform 1, project beyond projection holes 27 of said external cylinder 26. The diameter of said projection holes 27, $D_2$, and the diameter of the root portions of said bristles 2, $D_1$, have the relation of $D_1<D_2$ because silicone rubber tears easily. If $D_1=D_2$, that is to say if the edges of said projection holes 27 of said external cylinder 26 come in contact with said bristles 2, the bristles 2 would be likely to break. The direct contact of hair with said external cylinder 26 can improve the curling of hair.

FIGS. 14 to 16 show a sixth embodiment of the present invention. Silicone rubber bristle-mounting platform 1 with silicone rubber bristles 2 extending from its top surface, is manufactured in flat plate form, and mounted integrally on the bottom surface of a flexible plate 28 made of a highly thermal conductive metal such as aluminum. Bristles 2 extend through projection holes 27 of metal plate 28. A pair of parallel flanges 29 extends from opposing edges of the bottom surface of flexible metal plate 28. Bristles 2 are integral with bristle-mounting platform 1 and project beyond projection holes 27 of metal plate 28. Bristle-mounting platform 1 and flexible metal plate 28 are mounted around an internal cylinder 4 provided with a lengthwise slit 19 by bending flanges 29 of metal plate 28 around the edges of internal cylinder 4 which define slit 19. This forms rod assembly D which is capped by a cap at one end, the other end being attached to the main body of the hair appliance. The diameter of projection holes 27 $D_2$ and the diameter of the root portions of said bristles 2 $D_1$ are such that $D_1<D_2$ for the above-mentioned reason.

FIGS. 17 to 20 show a seventh embodiment of the present invention. Bristle-mounting platform 1 is constructed from a plurality of bristle-mounting strips 30 spaced from one another about a cylindrical axis at fixed intervals to form rod assembly D. One end of rod assembly D is capped by a cap and the other end is secured to casing 25 of the main body 5 of the hair appliance. Each bristle-mounting strip 30 comprises a silicone rubber bristle element strip 32 with an internal core strip 31 of springy materials. Silicone rubber bristles 2 are integral with and extend from each bristle element strip 32. The ends of said bristle-mounting strips 30 are retained by cap 15 and casing 25 of main body 5 of a hair appliance. The gaps between bristle-mounting strips 30 serve as hot air outlets 14. The ends of core strips 31 project beyond the ends of their respective bristle element strips 32 and are inserted into grooves 35 of cap 15 and casing 25. A supporting axis 33 extends from cap 15 and is secured to casing 25 by a screw. Outlets 34 in casing 25 permit hot air to be conveyed from main body 5 to the interior of rod assembly D. Bristle-mounting strips 30 are springy and flex when hair is wound round the hair curler. Hair is placed under tension from the inside of the wound hair and thereby curling can be improved.

Figure 21:
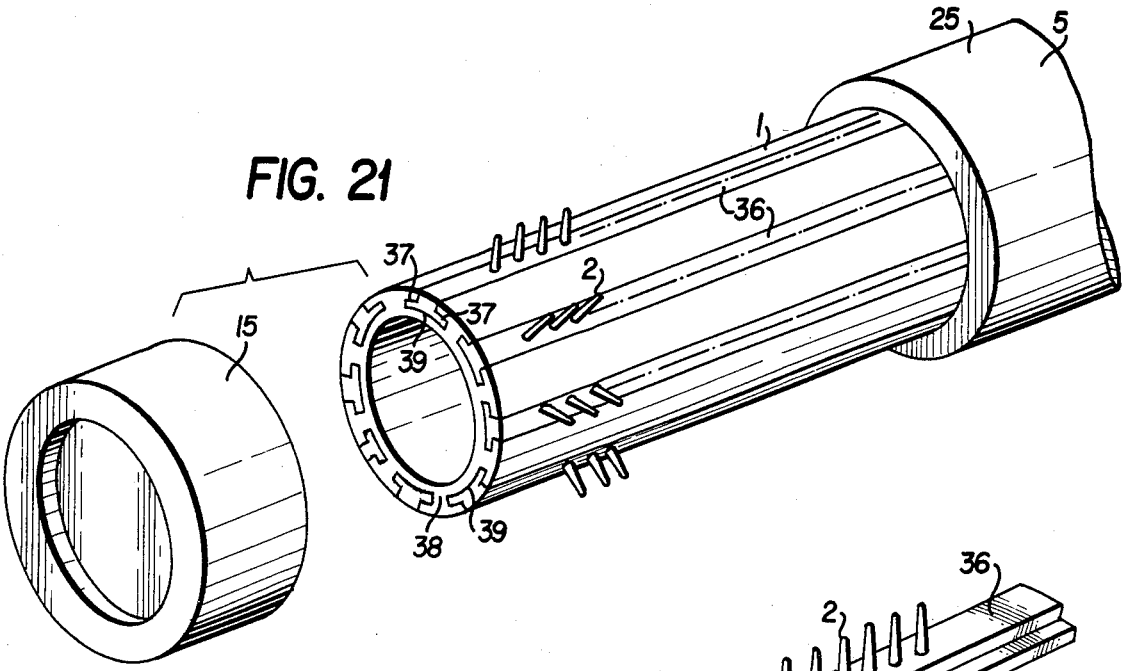
FIG. 21 is an exploded perspective view showing the hair-winding portion of an eighth embodiment of the hair curler of the claimed invention.
Figure 22:
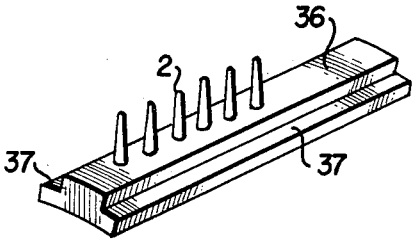
FIG. 22 is a perspective view of one of the bristle-mounting strips of the hair curler of FIG. 21.

FIGS. 21 and 22 show an eighth embodiment of the present invention. Hair-winding cylinder 38 is provided with grooves 39 on its external surface. The grooves 39 are spaced from one another and extend in the axial direction of cylinder 38. Each groove has the cross-section of an inverted T. A silicone rubber bristle-mounting strip 36 is inserted in each groove to form a rod assembly. One end of the rod assembly is capped by cap 15 and the other end is secured to casing 25 of main body 5 of the hair appliance. Each strip 36 has the cross-section of an inverted T complementary to its respective groove 39 and includes a pair of parallel fastener flanges 37 which extend along its sides at its lower surface and silicone rubber bristles 2 which extend from its upper surface. The strips 36 are further retained by casing 25 of main body 5 and cap 15.

Figure 23:
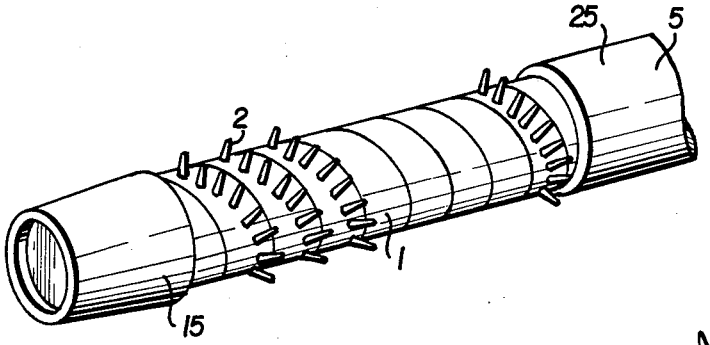
FIG. 23 is a perspective view showing the hair-winding portion of a ninth embodiment of the hair curler of the claimed invention.
Figure 24:
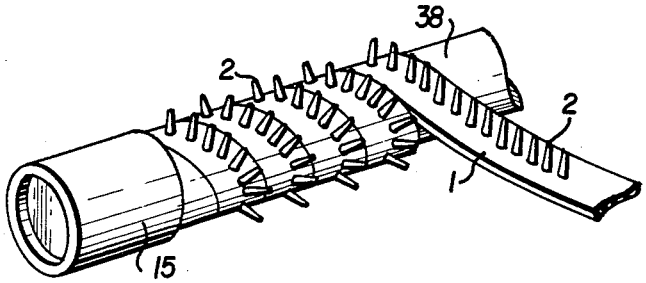
FIG. 24 is a perspective view showing the mode of incorporation of the bristle-mounting platform of the hair curler of FIG. 23.
Figure 25:
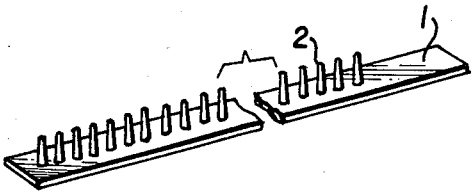
FIG. 25 is a partial perspective view of the bristle-mounting platform of the hair curler of FIG. 23.

FIGS. 23 to 25 show a ninth embodiment of the present invention. A silicone rubber bristle-mounting element 1 from which extend silicone rubber bristles 2 is formed in a flexible narrow band. Said bristle-mounting element 1 is wound spirally around relatively hard hair-winding cylinder 38 to form a rod assembly. Casing 25 of main body 5 and cap 15 fit over the bristle-mounting element 1 at the ends of cylinder 38 to retain it thereon.

Figure 29:
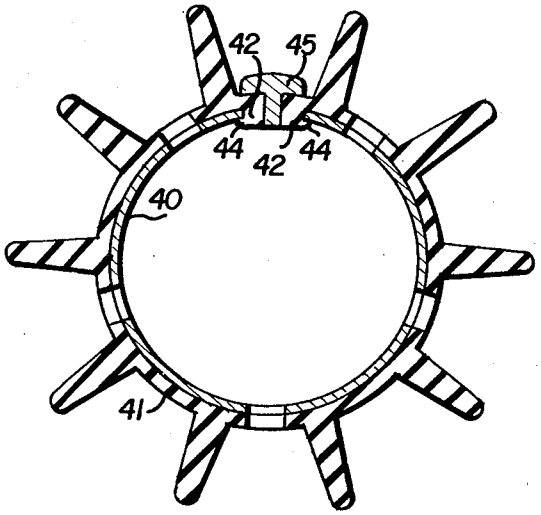
FIG. 29 is a side view, in cross-section, of the hair curler of FIG. 28, taken along the line D–D'.
Figure 28:
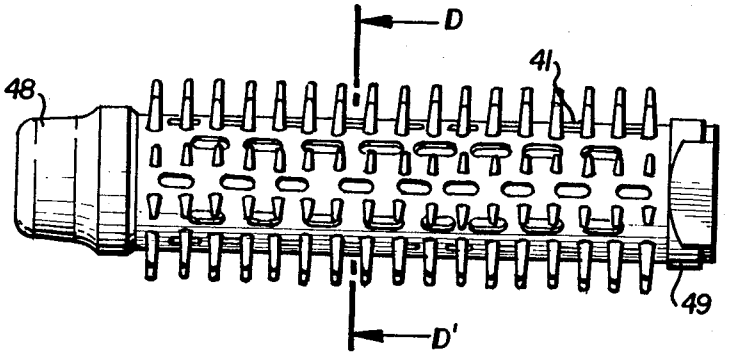
FIG. 28 is a front view of the hair-winding portion of a tenth embodiment of the hair curler of the claimed invention.
Figure 30:
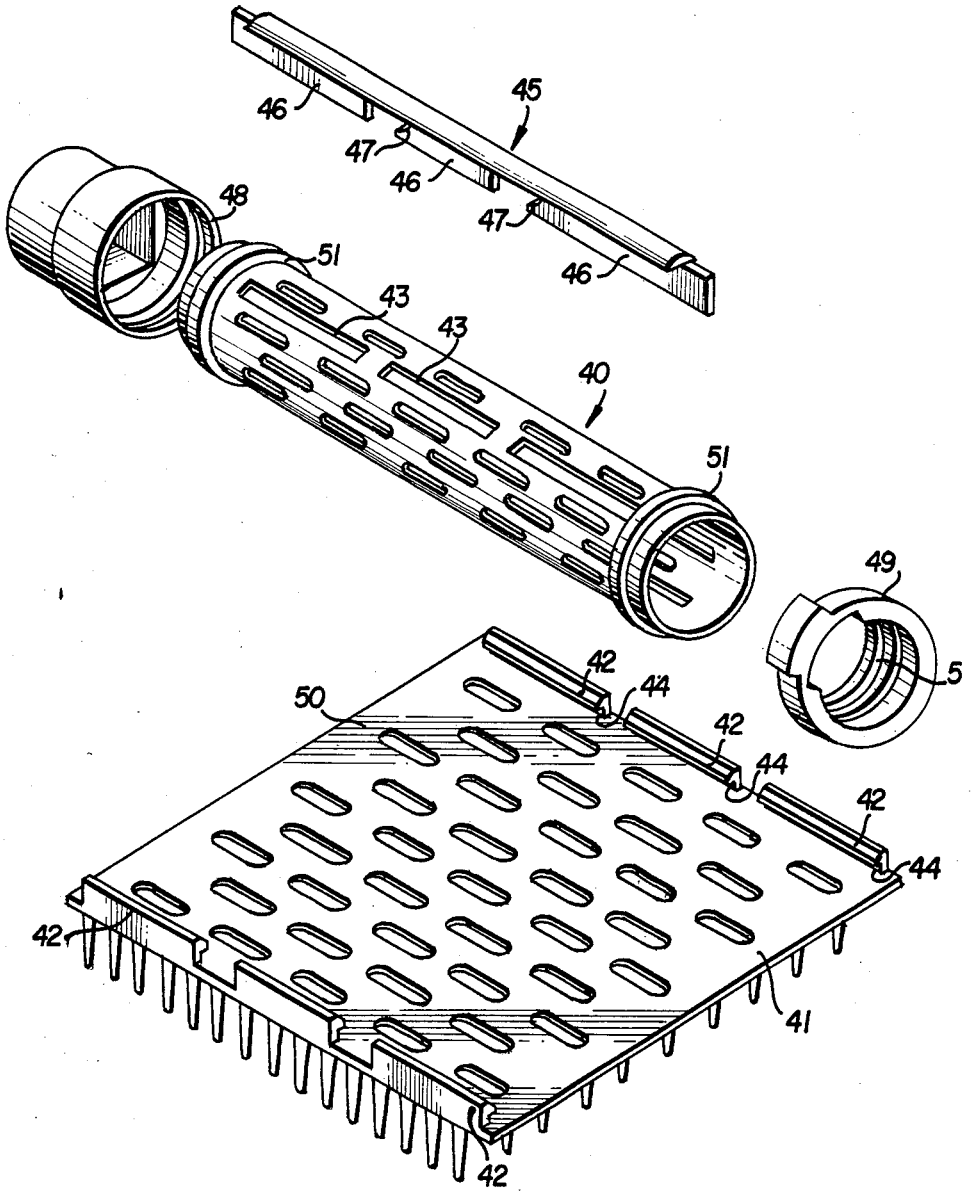
FIG. 30 is an exploded perspective view of the hair curler of FIG. 28 showing the bristle-mounting platform in its configuration prior to incorporation therein.

FIGS. 28 to 30 show a tenth embodiment of the present invention. A silicone rubber bristle-mounting platform 41 is formed in a flat plate shape with silicone rubber bristles extending from its top surface. Two opposing edges of platform 41 form a pair of parallel flanges 50. A series of three hook fasteners 42 are provided along each of the other two opposing edges along the bottom surface of platform 41 so that there are three pairs of opposing hook fasteners 42. The hook portions 44 of the hook fasteners 42 of each opposing pair face each other. The bristle-mounting platform 41 is mounted around a cylinder 40 to form a rod assembly. Cylinder 40 has a series of three colinear hook insertion slits 43 extending axially along its length, there being one hook insertion slit 43 for each pair of opposing hook fasteners 42. At each end of cylinder 40 is a lip 51. Platform 41 is mounted around cylinder by inserting each pair of opposing hook fasteners 42 in its respective insertion slit 43. On insertion, the hook portions 44 of each hook fastener 42 of each pair engage with the respective edge portions of cylinder 40 which defines their respective insertion slit 43. In addition, an insert fastener 45 is employed which has three colinear insert tabs 46 corresponding to the insertion slits 43. At least some of the insert tabs have locking notches 47 at one of their ends. Each tab 46 is inserted in its respective insertion slit 43 between the two members of the hook fastener pair already inserted and engaged. The insert fastener 45 is then moved axially to engage the fastening notches 47 of the insert tabs 46 with cylinder 40 on which platform 41 has been placed. A front cap 48 and rear cap 49 are then placed over the ends of cylinder 40. Caps 48 and 49 have fitting grooves 53 and fit over lips 51 to secure flanges 50 of platform 41 to cylinder 40.

I claim:

1. A hair applicance having a main body and a hair-winding portion, said hair-winding portion comprising a hollow rod assembly and a cap, said hollow rod assembly comprising:

a hollow cylinder;

an initially flat bristle-mounting platform having integrally formed means for fastening to said hollow cylinder and being formed about and enveloping said cylinder, said platform being made of flexible silicone rubber;

bristles integral with and extending outwardly from one surface of said platform, said bristles being made of flexible silicone rubber;

said means for fastening comprising a pair of protrusions extending from opposing edges of the surface of said platform which is opposite to the surface from which said bristles extend;

said cap being fitted over one end of said hollow rod assembly, the other end of said hollow rod assembly being mounted on said main body.

2. The hair appliance of claim 1 wherein said hollow cylinder is made of a highly thermal conductive metal.

3. The hair appliance of claim 2 wherein said highly thermal conductive metal is aluminum.

4. The hair appliance of claims 1, 2 or 3 wherein said hollow cylinder and said platform include corresponding hot air outlets.

5. The hair appliance of claim 1 wherein said fastening means comprises a pair of opposing parallel fastening channels extending from opposing edges of the surface of said platform which is opposite to the surface from which said bristles extend and wherein said hollow cylinder is provided with a slit along its length into which said pair of fastening channels may be inserted to engage the edges of said hollow cylinder which define said slit.

6. The hair appliance of claim 1 wherein said fastening means comprises a pair of parallel flanges extending from opposing edges of the same surface of said platform from which said bristles extend, said pair of flanges meeting to form a ridge along the length of said cylinder when said platform is mounted around said cylinder and wherein there is further provided a channel-shaped fastener adapted to receive and engage said ridge.

7. The hair appliance of claim 1 wherein said platform is provided with lengthwise grooves spaced from one another on the same surface of said platform from which said bristles extend and highly thermal conductive metal strips inserted in said grooves.

8. The hair appliance of claim 7 wherein said highly thermal conductive metal is aluminum.

9. The hair appliance of claim 7 wherein said metal strips have hot air outlets.

10. The hair appliance of claim 1 wherein said platform in flat plate form prior to incorporation into said hollow rod assembly is mounted on the bottom surface of a highly thermal conductive metal plate, said metal plate being flexible and having perforations, said bristles passing through said perforations, the diameter of said bristles being less than the diameter of said perforations, said metal plate also including a pair of opposed parallel metal flanges extending from opposing edges of its bottom surface;

11. A hair-winding attachment for a hair appliance having a main body, said hair-winding attachment comprising a hollow rod assembly and a cap, said hollow rod assembly comprising, a hollow cylinder;

an initially flat bristle-mounting platform having integrally formed means for fastening to said hollow cylinder and being formed about and enveloping said cylinder, said platform being made of flexible silicone rubber;

bristles integral with and extending outwardly from one surface of said platform, said bristles being made of flexible silicone rubber;

said means for fastening comprising a pair of protrusions extending from opposing edges of the surface of said platform which is opposite to the surface from which said bristles extend;

said cap being fitted over one end of said hollow rod assembly, the other end of said hollow rod assembly being capable of being detachably mounted on said main body.

12. The attachment of claim 11 wherein said hollow cylinder is made of a highly thermal conductive metal.

13. The attachment of claim 12 wherein said highly thermal conductive metal is aluminum.

14. The attachment of claims 11, 18 or 19 wherein said hollow cylinder and said platform includes corresponding hot air outlets.

15. The attachment of claim 11 wherein said fastening means comprises a pair of opposing parallel fastening channels extending from opposing edges of the surface of said platform which is opposite to the surface from which said bristles extend and wherein said hollow cylinder is provided with a slit along its length into which said pair of fastening channels may be inserted to engage the edges of said hollow cylinder which define said slit.

16. The attachment of claim 11 wherein said fastening means comprises a pair of parallel flanges extending from the opposing edges of the same surface of said platform from which said bristles extend, said pair of flanges meeting to form a ridge along the length of said cylinder when said platform is mounted around said cylinder and wherein there is further provided a channel-shaped fastener adapted to receive and engage said ridge.

17. The attachment of claim 11 wherein said platform is provided with lengthwise grooves spaced from one another on the same surface of said platform from which said bristles extend and highly thermal conductive metal strips inserted in said grooves.

18. The attachment of claim 17 wherein said highly thermal conductive metal is aluminum.

19. The attachment of claim 17 or 25 wherein said metal strips have hot air outlets.

20. The attachment of claim 11 wherein said fastening means includes three opposing parallel pairs of hook fasteners extending from one of the pairs of opposing edge of the surface of said platform opposite the surface from which said bristles extend, the hook portions of each hook fastener of each hook fastener pair facing each other, said platform having opposing parallel flanges extending from the other pair of opposing edges of said platform;

said hollow cylinder having three colinear fastener insertion holes, each said insertion hole adapted to receive and engage one of said pairs of hook fasteners;

an insert fastener with three colinear insert tabs, each said insert tab adapted to be received in one of said insertion holes between the three hook fasteners of each engaged hook fastener pair, at least one pair of said insert tabs at one of its ends having a lock notch capable of engaging one end of its respective insertion hole;

said hollow cylinder having a lip near each of two ends; and a pair of caps, each said cap adapted to be fitted over one of said lips after said platform is mounted to retain said platform on said cylinder.

* * * * *